US006886897B2

(12) United States Patent
Park

(10) Patent No.: US 6,886,897 B2
(45) Date of Patent: May 3, 2005

(54) APPARATUS TO ADJUST THE HEAD GAP IN INK-JET PRINTERS

(75) Inventor: Yong-myoun Park, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/453,667

(22) Filed: Jun. 4, 2003

(65) Prior Publication Data

US 2004/0008231 A1 Jan. 15, 2004

(30) Foreign Application Priority Data

Jul. 10, 2002 (KR) ..... 2002-40099

(51) Int. Cl.[7] ..... B41J 25/308

(52) U.S. Cl. ..... 347/8; 400/55; 400/56; 400/57; 400/58; 400/59; 400/60

(58) Field of Search ..... 347/8; 400/55, 400/56, 57, 58, 59, 60

(56) References Cited

U.S. PATENT DOCUMENTS 4,738,552 A * 4/1988 Kikuchi et al. ..... 400/59

5,131,765 A * 7/1992 Bradley et al. ..... 400/55

* cited by examiner

*Primary Examiner*—Stephen D. Meier
*Assistant Examiner*—Ly T Tran
(74) *Attorney, Agent, or Firm*—Staas & Halsey LLP

(57) ABSTRACT

A head gap adjusting apparatus used with an ink-jet printer, in which there are provided a pair of carrier shaft lifting parts disposed upon a chassis to adjust the head gap between a paper and a print head by converting a force of horizontal motion to a force of vertical motion and transmit the converted force to a carrier shaft. Each of the carrier shaft lifting parts includes the following elements. A vertical opening is formed in the chassis to guide the end of the carrier shaft to be movable up and down. An elastic supporting member elastically supporting the carrier shaft within the vertical opening to prevent the carrier shaft from being freely moved during movements of the carrier for carrying out a printing. A horizontal moving device is for enabling an end of the carrier shaft to move up and down within the vertical opening against the elastic forces of the elastic supporting member during the horizontal movements thereof. Accordingly, there are provided the carrier shaft lifting parts converting the force of horizontal motion to the force of vertical motion. Therefore, the head gap can be simply and precisely adjusted in accordance with the variations of the thickness of the paper to be printed.

14 Claims, 3 Drawing Sheets

APPARATUS TO ADJUST THE HEAD GAP IN INK-JET PRINTERS

CROSS-REFERENCE TO RELATED APPLICATIONS

This application claims the benefit of Korean Application No. 2002-40099, filed Jul. 10, 2002, in the Korean Intellectual Property Office, the disclosure of which is incorporated herein by reference.

BACKGROUND OF THE INVENTION

1. Field of the Invention

The present invention relates to an apparatus to adjust the head gap of an ink-jet printer. More specifically, the present invention relates to an apparatus to adjust the head gap of an ink-jet printer, in which the gap between the paper and a print head is simply and precisely adjusted in accordance with the thickness of the paper in a simple manner.

2. Description of the Related Art

Generally as shown in FIG. 1, an ink-jet printer includes: a print head 30 with a nozzle 31 formed on its bottom, to discharge the ink; a carrier 20 with the print head 30 installed thereon; and a chassis 10 to secure the both ends of a guide rail 11 and a carrier shaft 50 to guide the movement of the carrier 20.

The carrier 20 includes a rear supporting bracket 51 and a slider 22 so that the carrier 20 can move to left and right sides along the carrier shaft 50 and the guide rail 11.

Accordingly, when a paper 40 is picked up by a pickup roller (not illustrated) from a paper-feeding tray or a cassette and is passed through under the print head 30 through a feeding roller 60, the print head 30 moves to the left and the right along the carrier shaft 50 and the guide rail 11, and at the same time, discharges the ink through a nozzle 31, thereby carrying out the printing.

In this ink-jet printer, however, generally the distance between the paper 40 and the nozzle 31 of the bottom of the print head 30 is constantly fixed. Accordingly, in the case where a thick paper such as an envelope or a post card is printed, the distance between the paper and the nozzle 31 of the bottom of the print head 30 is reduced or becomes irregular.

In this case, the ink is spread astray, and therefore, the resolution of the printing is aggravated.

In order to solve this problem in the conventional ink-jet printer, a head gap adjusting apparatus 90 (See FIG. 2) is installed on each of both ends (only one end 50*a* is illustrated) of the carrier shaft 50 so that the distance (called "head gap" below) between the paper 40 and the head can be adjusted in accordance with the thickness of the paper.

The head gap adjusting apparatus 90 includes: a vertical hole 91 formed at a relevant position of the chassis 10, to receive one end 50*a* of the carrier shaft 50; an elastic spring 92 elastically supporting the one end 50*a* of the carrier shaft 50 within the hole 91 to prevent any loose movements of the end 50*a* of the carrier shaft 50 during the printing movements of the carrier 20; and a head gap adjusting plate 93 movably securing the end 50*a* of the carrier shaft 50 within the vertical hole 91 to make the end 50*a* of the carrier shaft 50 move up and down against the elastic force of the spring 92, so as to adjust the head gap.

One end 92*a* of the elastic spring 92 is supported at a first supporting protuberance 16 of the chassis 10 and is inserted into a supporting hole 14. Another end 92*b* of the elastic spring 92 is supported at a second supporting protuberance 18 of the chassis 10 so as to press an end 50*a* of the carrier shaft 50 to a position below the vertical hole 91.

The head gap adjusting plate 93 includes: a rotation shaft 94 formed on the lower portion of the head gap adjusting plate 93, to make it possible for the head gap adjusting plate 93 to pivot over the chassis 10; a spiral cam hole 95 to move the end 50*a* of the carrier shaft 50 up and down against the elastic forces of the elastic spring 92 during the pivoting of the head gap adjusting plate 93 around the rotation shaft 94; a saw tooth part 96 to adjust the pivoting of the head gap adjusting plate 93 in cooperation with an adjusting protuberance 19 of the chassis 10; a screw part 98 fastened to a screw hole (not illustrated) of the chassis 10, to fix the head gap adjusting plate 93 to the adjusted position after the head gap adjusting plate 93 is adjusted to the desired position through the saw tooth part 96 by pivoting the head gap adjusting plate 93; and a knob 99 to pivot the head gap adjusting plate 93.

This head gap adjusting apparatus 90 will be described as to its operation below.

In the case where the head gap is expanded to print an envelope, a post card and the like, first the screw part 98 is loosened so that the head gap adjusting plate 93 can be pivoted around the rotation shaft 94 along a slide hole 97 in the direction of the arrow mark A or B.

After the screw part 98 is loosened, the head gap adjusting part 93 is pivoted with the knob 99 around the rotation shaft 94 along the slide hole 97 in the direction of the arrow mark B. Accordingly, the spiral cam hole 95, which is inclined to have a level higher when positioned in the direction of the arrow mark A, moves in the direction of the arrow mark B, as shown in FIG. 2, so as to lift the end 50*a* of the carrier shaft 50.

At this time, the degree of pivoting the head gap adjusting plate 93 by the knob 99 is adjusted with the saw tooth part 96 and the adjusting protuberance 19.

Thus, when the head gap adjustment is completed through the pivoting of the head gap adjusting plate 93, the screw part 98 is tightened into the screw hole of the chassis 10 to fix the head gap adjusting plate 93 to the adjusted position.

On the other hand, in the case where the head gap is to be reduced to print a general size paper, i.e., 8.5'×11" or A4, the head gap adjusting plate 93 is pivoted in a direction opposite to that which is described above, thereby lowering the carrier shaft 50 to the original position.

In this conventional head gap adjusting apparatus 90, however, to adjust the head gap, there is separately employed the head gap adjusting plate 93, which is very complicated.

Consequently, the number of the components is increased, which increases the manufacturing costs. Further, if the head gap is to be adjusted, the screw part 98, which has the head gap adjusting plate 93 securely fixed, has to be loosened, and the head gap adjusting plate 93 has to be adjusted by pivoting it, and then and, the screw part 98 has to be tightened. Thus the adjusting procedure is very complicated and troublesome.

Further, in this conventional head gap adjusting apparatus 90, the pivoting degree of the head gap adjusting plate 93 to adjust the head gap is determined by the saw tooth part 96 and the adjusting protuberance 19.

Accordingly, the saw tooth part 96 has to be designed to have a certain size large enough to maintain the head gap adjusting plate 93 at the adjusted position against the elastic force of the elastic spring 92. Therefore, fine adjustments to cater to various levels of paper thickness are impossible.

SUMMARY OF THE INVENTION

Accordingly, it is an aspect of the present invention to provide a head gap adjusting apparatus for an ink-jet printer in which the gap between the paper and the print head can be simply and precisely adjusted in accordance with the variations of the paper thickness.

It is another aspect of the present invention to provide a head gap adjusting apparatus used with an ink-jet printer, in which there is provided a carrier shaft lifting part to adjust the head gap by converting a horizontal motion to a vertical motion.

Additional aspects and advantages of the invention will be set forth in part in the description which follows and, in part, will be obvious from the description, or may be learned by practice of the invention.

The foregoing and/or other aspects of the present invention are achieved by providing that a head gap adjusting apparatus used with an ink-jet printer having a print head to carry out a print by discharging an ink to a paper, a carrier to install the print head and to carry the print head along a carrier shaft, and a chassis to secure the carrier shaft, comprises: at least one carrier shaft lifting unit disposed on the chassis with respect to the carrier shaft, to convert a force of horizontal motion to a force of vertical motion and transmit the converted force to the carrier shaft so as to adjust a gap between the paper and the print head by lifting and lowering the carrier shaft.

In an embodiment of the present invention, the carrier shaft lifting unit includes: a vertical opening formed in the chassis to guide an end of the carrier shaft to be movable up and down; an elastic supporting member to elastically support the carrier shaft within the vertical opening to prevent the carrier shaft from being freely moved during movements of the carrier to carry out a printing; and a horizontal moving device to enable the end of the carrier shaft to move up and down within the vertical opening against elastic forces of the elastic supporting member during horizontal movement of the horizontal moving device.

The elastic supporting member comprises an elastic spring which includes: an end supported by a first supporting protuberance, the first supporting protuberance being formed on the chassis; and another end supported by a second supporting protuberance on the chassis near the vertical opening, so as to press down the end of the carrier shaft to below the vertical opening.

The horizontal moving device includes: an actuation part disposed to contact the end of the carrier shaft to move the end of the carrier shaft up and down during its horizontal movements; a securing part to support the actuation part to be contacted to the carrier shaft; and a motion adjusting part to gradually move the actuation part in the horizontal direction to cause the end of the carrier shaft to progressively move up and down for fine adjustments of the head gap.

The actuation part preferably comprises a rod having a truncated conical portion to contact at least the end of the carrier shaft. The securing part preferably comprises a bracket to movably support the rod.

Further, the motion adjusting part includes: a threaded part formed on one of end portions of the rod; a threaded hole formed in the securing bracket to threadably receive the threaded part; and a turning knob formed on another end portion of the rod. Under this condition, the turning knob is provided with a driving groove so that the rod can be rotated with a driver or the like.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DESCRIPTION OF THE PREFERRED EMBODIMENTS

Figure 1:
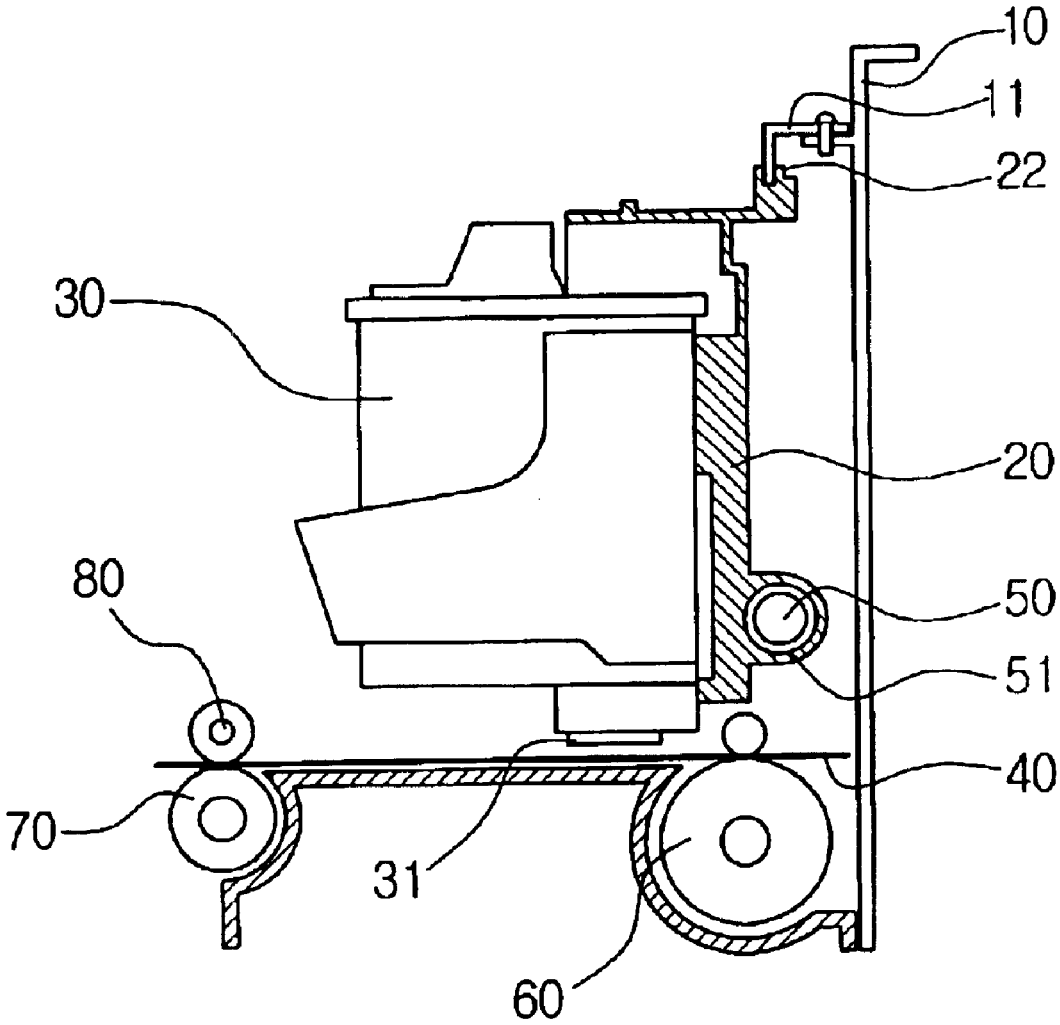
FIG. 1 (PRIOR ART)
FIG. 1 is a partial perspective view of the conventional ink-jet printer.
Figure 2:
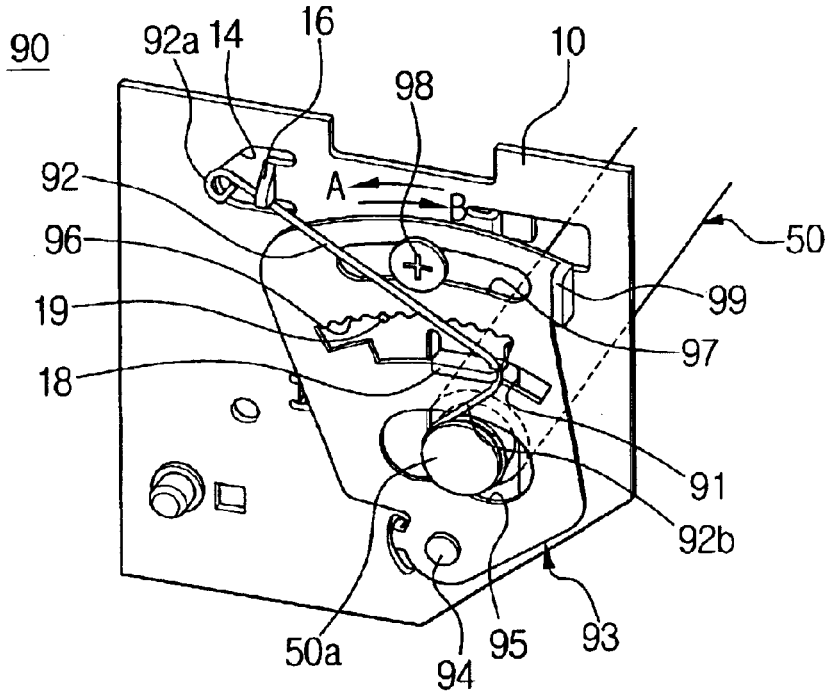
FIG.2 (PRIOR ART)
FIG. 2 is a perspective view of the head gap adjusting apparatus of the conventional ink-jet printer of FIG. 1.

Reference will now made in detail to the preferred embodiments of the present invention, examples of which are illustrated in the accompanying drawings, wherein like reference numerals refer to the like elements throughout. The embodiments are described below in order to explain the present invention by referring to the figures.

Figure 3:
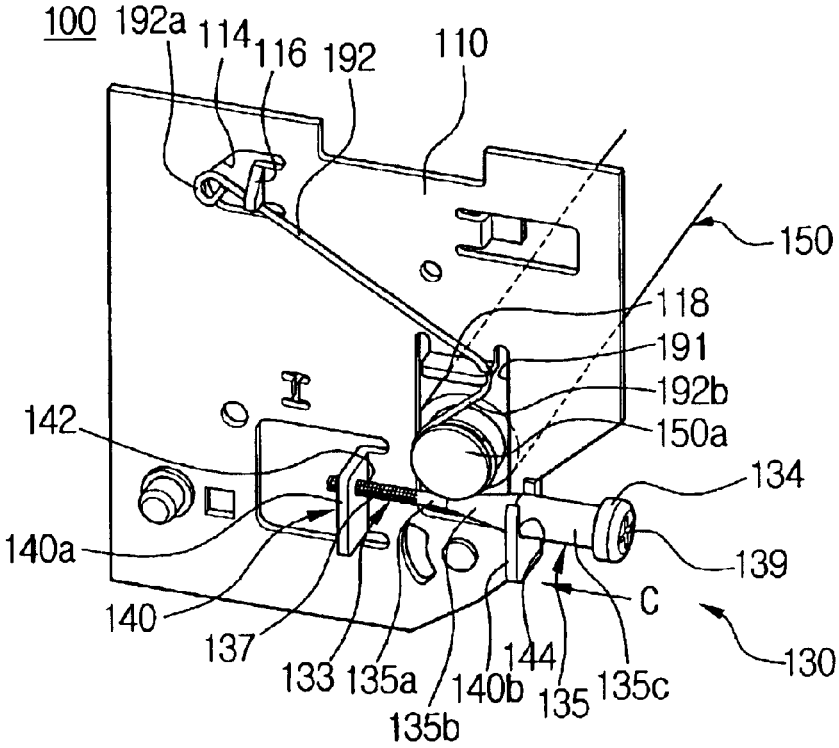
FIG. 3 is a perspective view of a head gap adjusting apparatus of the ink-jet printer according to an embodiment of the present invention.

FIG. 3 illustrates a head gap adjusting apparatus 100 used with an ink-jet printer according to the present invention.

As described while referring to FIG. 3, the head gap adjusting apparatus 100 according to the present invention includes: a print head (not illustrated) to carry out prints by discharging the ink; a carrier (not illustrated) with the print head installed thereon to move the print head along a carrier shaft 150; and a chassis 110 to movably secure the carrier shaft 150.

The head gap adjusting apparatus 100 according to the present invention further includes: a pair of carrier shaft lifting parts 130 disposed on the chassis 110 with respect to the carrier shaft 150 to convert a force of horizontal motion to a force of vertical motion and transmit the converted force so as to lift or lower both ends 150*a* (only one end is illustrated) of the carrier shaft 150, thereby ultimately adjusting the gap between a paper and the print head.

Each of the carrier shaft lifting parts 130 includes: a vertical hole or opening 191 formed in the chassis 110 to guide the end 150*a* of the carrier shaft 150 to be movable up and down; an elastic supporting member 192 to elastically support the carrier shaft 150 within the vertical opening 191 to prevent the carrier shaft 150 from being freely moved during movements of the carrier to carry out a printing; and a horizontal moving device 135, 140 and 133 to enable the end 150*a* of the carrier shaft 150 to move up and down within the vertical opening 191 against elastic forces of the elastic supporting member 192 during horizontal movements thereof.

The elastic supporting member 192 includes an elastic spring which includes: an end 192*a* inserted into a supporting hole 114 and supported by a first supporting protuberance 116, the first supporting protuberance 116 being formed on the chassis 110; and another end 192*b* supported by a second supporting protuberance 118 on the chassis 110 near the vertical opening 191, so as to press down the end 150*a* of the carrier shaft 150 to a position below the vertical opening 191.

The horizontal moving device 135, 140 and 133 includes: an actuation part 135 disposed to contact the end 150*a* of the carrier shaft 150 to move the end 150*a* of the carrier shaft 150 up and down during its horizontal movements; a securing part 140 to support the actuation part 135 to be contacted to the end 150*a* of the carrier shaft 150; and a motion adjusting part 133 to gradually move the actuation part 135 in a horizontal direction to cause the ends 150*a* of the carrier shaft 150 to progressively move up and down for fine adjustments of the head gap.

The actuation part 135 includes a stepped rod having: a minor diameter part 135*a*, a major diameter part 135*c*, and a truncated conical portion 135*b* formed between the minor diameter part 135*a* and the major diameter part 135*c*. The securing part 140 includes a bracket formed on the chassis 110 to movably support the stepped rod 135, and having a first projected securing plate 140*a* and a second projected securing plate 140*b*.

The first projected securing plate 140*a* has a threaded hole 142 to threadably receive a threaded part 137 of the motion adjusting part 133 to be described later, extending from the end of the minor diameter part 135*a* of the stepped rod 135. The second projected securing plate 140*b* has a supporting opening 144 to support the major diameter part 135*c* of the stepped rod 135.

The motion adjusting part 133 comprises: a threaded part 137 extending from the minor diameter part 135*a* of the stepped rod 135; a threaded hole 142 formed in the first projected securing plate 140*a* to threadably receive the threaded part 137; and a turning knob 134 formed on the major diameter part 135*c* of the stepped rod 135. Under this condition, the turning knob 134 is provided with a driving groove 139 so that the stepped rod 135 can be rotated with a driver or the like.

Thus, in the head gap adjusting apparatus 100 of the present invention, when the actuation part 135 is rotated with the turning knob 134, the truncated conical portion 135*b* of the stepped rod 135 moves to the left or the right to lift or lower the ends 150*a* of the carrier shaft 150, thereby adjusting the head gap.

Further, in the head gap adjusting apparatus 100 of the present invention, the motion adjusting part 133 includes the threaded part 137 to be threadably coupled into the threaded hole 142, and therefore, the head gap can be more finely adjusted as compared with the conventional head gap adjusting apparatus 90 in which there is involved the rough saw tooth part 96.

In the above, the head gap adjusting apparatus 100 was described such that the actuation part 135 is horizontally moved by utilizing the motion adjusting part 133 including the threaded part 137 to be coupled into the threaded hole 142. However, the present invention is not limited to this type, but can be extended to such a type that an actuation part is horizontally moved without rotating it. For example, there can be adopted: a rack with an inclined face contact to the carrier shaft; and a pinion with a rotation adjustment stopper formed thereon.

Figure 4A:
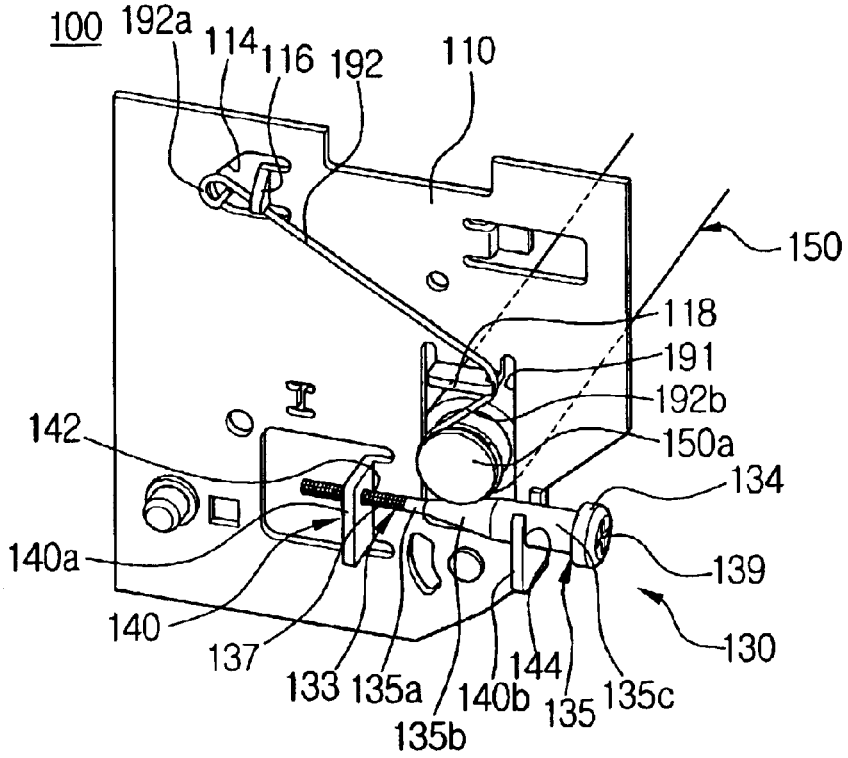
FIGS. 4A and 4B are perspective views illustrating the operation of the head gap adjusting apparatus of FIG. 3.
Figure 4B:
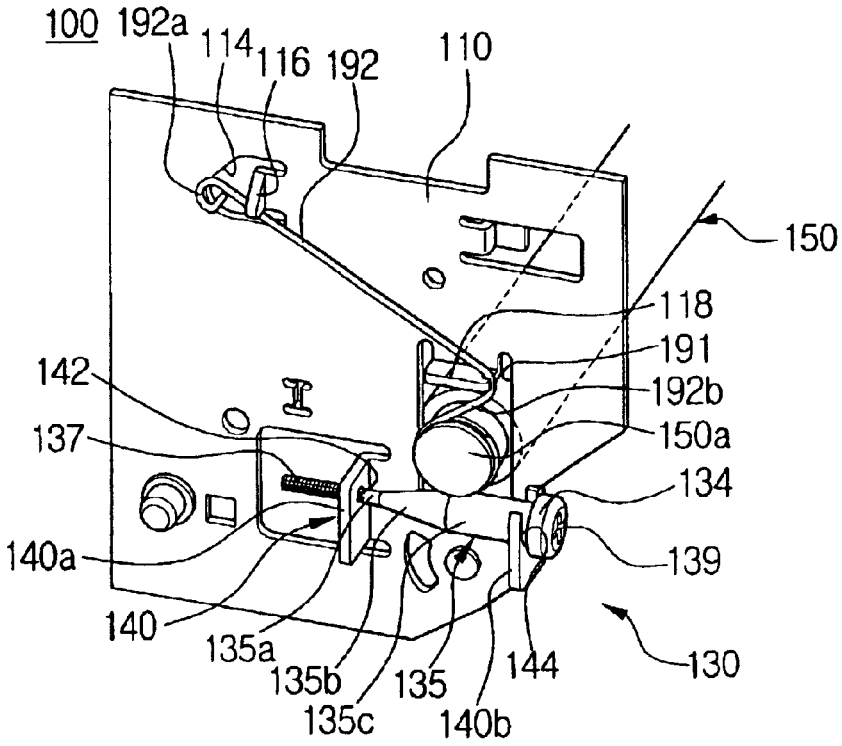

The head gap adjusting apparatus 100 constituted as above will now be described as to its operation referring to FIGS. 3, 4A and 4B.

As shown in FIG. 3, in the case where the head gap is adjusted from a narrow gap position printing a general paper with the end 150*a* of the carrier shaft 150 positioned at the minor diameter part 135*a* of the actuation part 135, to the medium gap position printing a slightly thick paper such as an envelope or a post card which is slightly thicker than the general paper, the rotation knob 134 of the actuation part 135 is rotated in one direction, for example, clockwise.

When the actuation part 135 is rotated clockwise, the threaded part 137 of the motion adjusting part 133 is threadably inserted into the threaded hole 142, resulting in that the actuation part 135 moves leftward, i.e., in the direction of the arrow mark C.

In this manner, when the actuation part 135 moves leftward, the truncated conical portion 135*b* of the actuation part 135 lifts up the end 150*a* of the carrier shaft 150. As a result, as shown in FIG. 4A, the end 150*a* of the carrier shaft 150 is positioned at the medium gap position, thereby completing the adjustment.

Thereafter, if the head gap is to be further increased to print a paper thicker than a envelope, post card and the like, then the actuation part 135 is further moved leftward by rotating the knob 134 in the same manner as described above. Accordingly, as shown in FIG. 4B, the end 150*a* of the carrier shaft 150 is mounted upon the major diameter part 135*c* of the actuation part 135, thereby realizing a wide gap position.

After completion of printing at this position, if general paper is to be printed again, then the rotation knob 134 is rotated in the opposite direction, i.e., counterclockwise. Thus the actuation part 135 is moved rightward, and therefore, the truncated conical portion 135*b* of the actuation part 135 lowers the end 150*a* of the carrier shaft 150.

As a result, as shown in FIG. 3, the end 150*a* of the carrier shaft 150 is positioned at the narrow gap position, thereby completing the adjustment.

According to the present invention as described above, there are provided the carrier shaft lifting parts to convert the force of horizontal motion to the force of vertical motion. Therefore, the head gap can be simply and precisely adjusted in accordance with the variations of the thickness of the paper to be printed.

Although an embodiment of the present invention has been shown and described, it would be appreciated by those skilled in the art that changes may be made in this embodiment without departing from the principles and spirit of the invention, the scope of which is defined in the claims and their equivalents.

What is claimed is:

1. A head gap adjusting apparatus used with an ink-jet printer having a print head to carry out a print by discharging an ink to a paper, a carrier to install the print head and to carry the print head along a carrier shaft, and a chassis to secure the carrier shaft, comprising:

at least one carrier shaft lifting unit disposed on the chassis with respect to the carrier shaft to convert a force of horizontal motion to a force of vertical motion and transmit the converted force to the carrier shaft to adjust a gap between the paper and the print head by lifting and lowering the carrier shaft; and a horizontal moving device to enable the end of the carrier shaft to move up and down during linear horizontal movement of the horizontal moving device.

2. The head gap adjusting apparatus according to claim 1, wherein the at least one carrier shaft lifting unit comprises:

a vertical opening formed in the chassis to guide an end of the carrier shaft to be movable up and down; and an elastic supporting member to elastically support the carrier shaft within the vertical opening to prevent the carrier shaft from being freely moved during movements of the carrier to carry out a printing, wherein the horizontal moving device enables the end of the carrier shaft to move up and down within the vertical opening against elastic forces of the elastic supporting member.

3. The head gap adjusting apparatus according to claim 2, wherein the elastic supporting member comprises an elastic spring, the elastic spring comprising:

an end portion supported by a first supporting protuberance, the first supporting protuberance being formed on the chassis; and another end portion supported by a second supporting protuberance on the chassis near the vertical opening to press down the end of the carrier shaft to below the vertical opening.

4. The head gap adjusting apparatus according to claim 3, wherein the horizontal moving device comprises:

an actuation part disposed to contact the end of the carrier shaft to move the end of the carrier shaft up and down during its horizontal movements;

a securing part to support the actuation part to contact the carrier shaft; and a motion adjusting part to gradually move the actuation part in the horizontal direction to cause the end of the carrier shaft to progressively move up or down for fine adjustments of the head gap.

5. The head gap adjusting apparatus according to claim 2, wherein the at least one carrier shaft lifting unit comprises first and second carrier shaft lifting units each at one end of the carrier shaft, respectively.

6. A head gap adjusting apparatus used with an ink-jet printer having a print head to carry out a print by discharging an ink to a paper, a carrier to install the print head and to carry the print head along a carrier shaft, and a chassis to secure the carrier shaft, comprising:

at least one carrier shaft lifting unit disposed on the chassis with respect to the carrier shaft to convert a force of horizontal motion to a force of vertical motion and transmit the converted force to the carrier shaft to adjust a gap between the paper and the print head by lifting and lowering the carrier shaft.

wherein the at least one carrier shaft lifting unit includes a vertical opening formed in the chassis to guide an end of the carrier shaft to be movable up and down, and an elastic supporting member to elastically support the carrier shaft within the vertical opening to prevent the carrier shaft from being freely moved during movements of the carrier to carry out a printing, wherein the horizontal moving device enables the end of the carrier shaft to move up and down within the vertical opening against elastic forces of the elastic supporting member, wherein the elastic supporting member having an elastic spring including an end portion supported by a first supporting protuberance, the first supporting protuberance being formed on the chassis, and another end portion supported by a second supporting protuberance on the chassis near the vertical opening to press down the end of the carrier shaft to below the vertical opening, wherein the horizontal moving device includes an actuation part disposed to contact the end of the carrier shaft to move the end of the carrier shaft up and down during its horizontal movements, a securing part to support the actuation part to contact the carrier shaft and a motion adjusting part to gradually move the actuation part in the horizontal direction to cause the end of the carrier shaft to progressively move up or down for fine adjustments of the head gap, and wherein the actuation part comprises a rod having a truncated conical portion formed to contact the end of the carrier shaft.

7. The head gap adjusting apparatus according to claim 6, wherein the securing part comprises a bracket to movably support the rod.

8. The head gap adjusting apparatus according to claim 7, wherein the motion adjusting part comprises:

a threaded part extending from one end portion of the rod;

a threaded hole formed in the securing bracket to threadably receive the threaded part; and a turning knob formed on another end portion of the rod.

9. The head gap adjusting apparatus according to claim 8, wherein the turning knob comprises a driving groove to enable rotation thereof with a driver.

10. A head gap adjusting apparatus used with an ink-jet printer having a print head to carry out a print by discharging an ink to a paper, a carrier to install the print head and to carry the print head along a carrier shaft, and a chassis to secure the carrier shaft, comprising:

at least one carrier shaft lifting unit disposed on the chassis with respect to the carrier shaft to convert a force of horizontal motion to a force of vertical motion and transmit the converted force to the carrier shaft to adjust a gap between the paper and the print head by lifting and lowering the carrier shaft, wherein the at least one carrier shaft lifting unit includes a vertical opening formed in the chassis to guide an end of the carrier shaft to be movable up and down, and an elastic supporting member to elastically support the carrier shaft within the vertical opening to prevent the carrier shaft from being freely moved during movements of the carrier to carry out a printing, wherein the horizontal moving device enables the end of the carrier shaft to move up and down within the vertical opening against elastic forces of the elastic supporting member, wherein the elastic supporting member having an elastic spring including an end portion supported by a first supporting protuberance, the first supporting protuberance being formed on the chassis, and another end portion supported by a second supporting protuberance on the chassis near the vertical opening to press down the end of the carrier shaft to below the vertical opening, wherein the horizontal moving device includes an actuation part disposed to contact the end of the carrier shaft to move the end of the carrier shaft up and down during its horizontal movements;

a securing part to support the actuation part to contact the carrier shaft; and a motion adjusting part to gradually move the actuation part in the horizontal direction to cause the end of the carrier shaft to progressively move up or down for fine adjustments of the head gap, and wherein the actuation part is a stepped rod including:

a minor diameter part;

a major diameter part; and a truncated conical portion formed between the minor diameter part and the major diameter part.

11. A head gap adjusting apparatus used with an ink-jet printer having a print head, a carrier installing the print head and carrying the print head along a carrier shaft, the head gap adjusting apparatus comprising:

a chassis securing the carrier shaft:

a screw-type rotatable carrier shaft lifting unit disposed on the chassis and in contact with the carrier shaft to adjust a gap between the paper and the print head by lifting and lowering the carrier shaft.

12. The head gap adjusting apparatus according to claim 11, wherein the screw-type rotatable carrier shaft lifting unit moves in a direction perpendicular to the moving direction of the carrier shaft.

13. The head gap adjusting apparatus according to claim 12, wherein the screw-type rotatable carrier shaft lifting unit comprises a conical portion to raise and lower the carrier shaft through the movement thereof in a linear direction.

14. The head gap adjusting apparatus according to claim 13, wherein the screw-type rotatable carrier shaft lifting unit has a threaded portion and rotates within a threaded hole, to move the screw-type rotatable carrier shaft lifting unit in the linear direction.

* * * * *